US005324336A

United States Patent [19]

Child

[11] Patent Number: 5,324,336

[45] Date of Patent: Jun. 28, 1994

[54] PARTIAL OXIDATION OF LOW RANK COAL

[75] Inventor: Edward T. Child, Tarrytown, N.Y.

[73] Assignee: Texaco Inc., White Plains, N.Y.

[21] Appl. No.: 941,006

[22] Filed: Sep. 4, 1992

Related U.S. Application Data

[63] Continuation of Ser. No. 762,204, Sep. 19, 1991, abandoned.

[51] Int. Cl.[5] ..... C10L 3/00

[52] U.S. Cl. ..... 44/608; 48/197 FM; 48/200; 252/373

[58] Field of Search ..... 44/608, 620; 252/373; 48/197 FM, 197 R, 200, 119, 98

[56] References Cited

U.S. PATENT DOCUMENTS

| | | | |
|---|---|---|---|
| 3,544,291 | 4/1968 | Schlinger et al. | 48/206 |
| 3,607,156 | 12/1968 | Schlinger et al. | 48/206 |
| 3,847,564 | 11/1974 | Marion et al. | 48/95 |
| 4,200,439 | 4/1980 | Lang | 44/620 |
| 4,204,843 | 5/1980 | Neavel | 44/620 |
| 4,237,101 | 12/1980 | Willard, Sr. | 44/608 |
| 4,402,706 | 9/1983 | Wunderlich | 44/608 |
| 4,492,588 | 1/1985 | Kralik et al. | 44/620 |
| 4,525,175 | 6/1985 | Stellaccio | 48/86 R |
| 4,741,278 | 5/1988 | Franke | 44/620 |

*Primary Examiner*—Margaret B. Medley

*Attorney, Agent, or Firm*—George J. Darsa; Kenneth R. Priem; Christopher Nicastri

[57] ABSTRACT

Abundant low cost low rank coal may now be gasified by partial oxidation or burned in a furnace or boiler. About 30 to 45 parts by wt. of comminuted low rank coal is mixed and reacted in the reaction zone of a partial oxidation gas generator with a free-oxygen containing gas and (a) about 1 to 3 parts by wt. of a residual fuel oil, and (b) about 70 to 55 parts by wt. of water. The hot effluent stream of synthesis gas, reducing gas or fuel gas from the partial oxidation gasifier may be purified to provide a gas stream which will not pollute the environment.

2 Claims, 1 Drawing Sheet

Legends:

BASIS: Production of 100MM SCFD of $H_2$ + CO

A–Reduction In Low Rank Coal

B–Reduction In Free-Oxygen Containing Gas

C–Increase In Cold Gas Efficiency

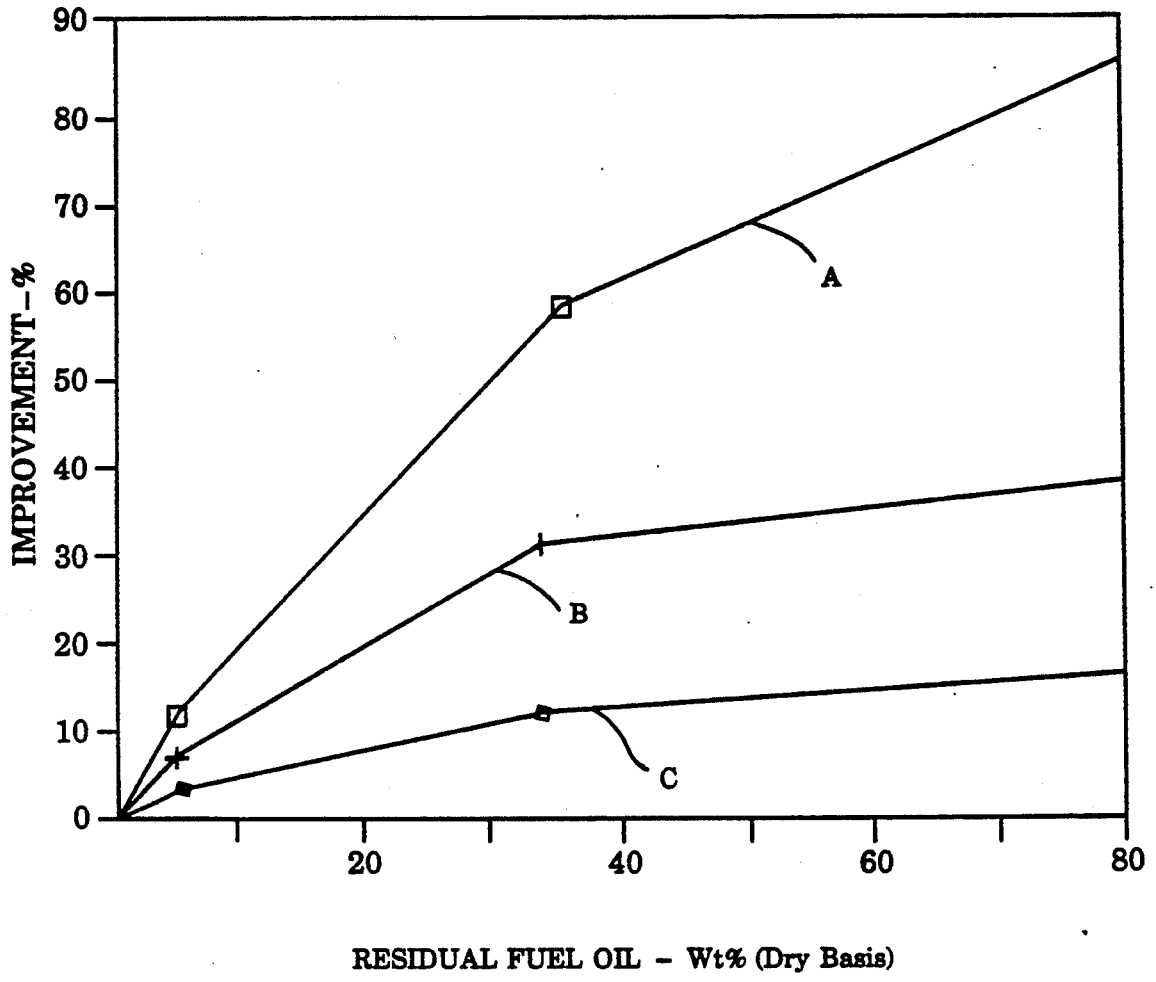
Legends:
BASIS: Production of 100MM SCFD of $H_2$ + CO
A – Reduction In Low Rank Coal
B – Reduction In Free-Oxygen Containing Gas
C – Increase In Cold Gas Efficiency

PARTIAL OXIDATION OF LOW RANK COAL

This is a continuation of application Ser. No. 07/762,204, filed Sep. 19, 1991 now abandoned.

BACKGROUND OF THE INVENTION

Field of the Invention

This invention relates to the partial oxidation of low rank coal. More particularly, the present invention relates to the partial oxidation of a novel fuel composition comprising low rank coal, heavy residual oil and water for the production of synthesis gas, fuel gas or reducing gas.

Alternate fuels are now required to replace the world's diminishing petroleum reserves. While there are large deposits of low rank coal in the world, the use of this low cost fuel has been very limited in the past. This is mainly because of excessive coal and oxygen requirements per unit of syngas (hydrogen plus carbon monoxide) produced. Further, environmental pollution may result when low rank coal is burned. By the subject invention, it is now economically attractive to gasify low rank coal. Further, environmental pollution may be eliminated or substantially reduced by the subject process and thermal efficiencies are increased.

Slurries of solid fuel and water are described in coassigned U.S. Pat. Nos. 3,544,291 and 3,607,156.

SUMMARY OF THE INVENTION

According to this invention, there is provided a process for the partial oxidation of low rank coal to produce synthesis gas, fuel gas, and reducing gas which comprises:

(1) mixing together about 30 to 45 parts by wt. of comminuted low rank coal selected from the group consisting of subbituminous, lignite and mixtures thereof and conforming with ASTM D388 Class III subbituminous and Class IV Lignitic fuel and about 70 to 55 parts by wt. of water to produce a pumpable aqueous low rank coal slurry stream;

(2) passing the aqueous-low rank coal slurry stream from (1) into the reaction zone of a free-flow partial oxidation gas generator by way of a first passage of a multi-passage burner;

(3) simultaneously passing into the reaction zone of said partial oxidation gas generator by way of a second passage in said multi-passage burner about 1 to 3 parts by wt. of a stream of residual fuel oil having a calorific value of at least 14,000 Btu/lb and conforming with Grades No. 4 to 6 of ASTM D-396;

(4) simultaneously passing a stream of free-oxygen containing gas into said reaction zone by way of at least one other free passage of said burner;

(5) impacting together in said reaction zone and atomizing and mixing together said stream of aqueous low rank coal slurry, said stream of residual fuel oil, and said stream of free-oxygen containing gas; and (6) reacting said mixture from (5) in said reaction zone of said partial oxidation gas generator at a temperature in the range of about 1800° F. to 3500° F., a pressure in the range of about 1 to 35 atmospheres, and an atomic ratio of free-oxygen to carbon in the range of about 0.85 to 1.5 to produce a hot effluent stream of synthesis gas, reducing gas or fuel gas.

BRIEF DESCRIPTION OF THE DRAWING

The drawing e.g. FIG. 1 depicts the beneficial effect of residual fuel oil addition to low rank coal-water slurries.

DISCLOSURE OF THE INVENTION

The subject invention pertains to a novel fuel composition comprising low rank coal and water in admixture with a liquid hydrocarbonaceous fuel, such as residual fuel oil. The pumpable fuel mixture may then be preferably burned with a free-oxygen containing gas in an entrained flow partial oxidation gasifier for the production of synthesis gas, fuel gas, or reducing gas. Alternatively, the fuel may be burned in a furnace or steam boiler.

The term low rank coal, as used herein, pertains to Class III subbitminous and Class IV Lignitic fuel, as shown in Table I of ASTM D388 and below.

TABLE I

| CLASS | GROUP | CALORIFIC VALUE *BTU per pound Equal or Greater Than | Less Than | AGGLOMERATING CHARACTER |
|---|---|---|---|---|
| III | Subbituminous | | | |
| | 1. Subbituminous A coal | 10,500 | 11,500 | nonagglomerating |
| | 2. Subbituminous B coal | 9,500 | 10,500 | nonagglomerating |
| | 3. Subbituminous C coal | 8,300 | 9,500 | nonagglomerating |
| IV | Lignitic | | | |
| | 1. Lignite A | 6,300 | 8,300 | nonagglomerating |
| | 2. Lignite B | — | 6,300 | nonagglomerating |

*Moist (coal containing its natural inherent moisture but not including visible water on the surface of the coal), Mineral-Matter-Free Basis The low rank coal is ground by conventional means to a particle size so that 100 wt. % passes through ASTM E11 Standard Sieve Designation 1.40 mm. The low rank coal is such a poor grade that a pumpable aqueous slurry made from said low rank coal will not have more than 45 wt. % solids.

Suitable liquid hydrocarbonaceous fuels include residual fuel oil, shale oil, waste hydrocarbon oil, asphalt, and mixtures thereof. The liquid hydrocarbonaceous fuel has a minimum heat content of about 14,000 Btu/lb. The residual fuel oil is the preferable liquid hydrocarbonaceous fuel. The residual fuel oil shall conform with Grades No. 4 to 6 of ASTM D-396, Standard Specification for Fuel Oils.

The following mixtures are recommended:

TABLE II

| | Preferred Comp. - Parts/wt. | Preferred Range - Parts/wt. | Broad Range - Parts/wt. |
|---|---|---|---|
| Low Rank Coal | 45 | 30 to 45 | 30–45 |
| Water | 55 | 70 to 55 | 70–55 |
| Liquid Hydrocarbonaceous Fuel e.g. residual fuel oil | 1 to 3 | 1 to 3 | 0.5–30 |

The term free-oxygen containing gas, as used herein is intended to include air, oxygen-enriched air, i.e. greater than 21 mole percent oxygen, and substantially pure oxygen, i.e. greater than 96 mole percent oxygen, (the remainder comprising $N_2$ and rare gases).

In a preferred embodiment, about 30 to 45 parts by weight of comminuted low rank coal is mixed with about 70 to 55 parts by weight of water to produce a pumpable aqueous slurry. The aqueous slurry of low rank coal is then mixed with about 0.5 to 30 parts by weight of liquid hydrocarbonaceous fuel, such as residual fuel oil. The mixture is then introduced by way of one passage of a conventional annular-type burner into a free-flow unobstructed down-flowing vertical refractory lined steel wall pressure vessel where the partial oxidation reaction takes place. A typical gas generator is shown and described in coassigned U.S. Pat. No. 3,544,291, which is incorporated herein by reference. The burner assembly is inserted downward through a top inlet port of the noncatalytic synthesis gas generator. The burner extends along the central longitudinal axis of the gas generator.

For example, by means of a conventional two-passage annular type burner, such as shown and described in coassigned U.S. Pat. No. 3,874,592, which is incorporated herein by reference, and comprising a central conduit and a coaxial concentric annular passage with a converging nozzle at the downstream end, a stream of free-oxygen containing gas at a temperature in the range of about ambient to 1000° F. may be passed through the central conduit or the annular passage while simultaneously the pumpable mixture of aqueous slurry of low rank coal and liquid hydrocarbonaceous fuel, such as residual fuel oil at a temperature in the range of about 100° F. to 250° F. is pumped through the remaining free passage. The two streams impact together inside the tip of the burner and/or downstream from the tip of the burner in the reaction zone of the partial oxidation gas generator. The expression and/or is used in its conventional manner. For example, it means here either inside the burner tip, downstream from the burner tip, or at both locations. The feedstreams are atomized, thoroughly mixed together, and are reacted together by partial oxidation in the gasifier. Alternatively, a conventional three passage annular-type burner, such as shown in coassigned U.S. Pat. No. 3,847,564, which is incorporated herein by reference, and comprising a central conduit and two coaxial concentric annular-shaped passages each equipped with a converging downstream nozzle may be used. In such case, simultaneously the feedstream of free-oxygen containing gas is passed through the central conduit and the outer annular-shaped passage, and the feedstream comprising a pumpable slurry mixture of low rank coal and liquid hydrocarbonaceous fuel, such as residual fuel oil is passed through the inner annular-shaped passage. The streams impact together either inside the burner tip, downstream from the tip of the burner in the reaction zone of the partial oxidation gas generator, or at both places. The feedstreams atomize, thoroughly mix together, and are reacted by partial oxidation. In a similar manner, the feedstreams may be introduced by said burner means and are burned in a furnace or boiler.

In still another embodiment, the feedstreams may be introduced into the reaction zone of a conventional partial oxidation gasifier by means of a four stream burner comprising a central conduit and three concentric coaxial annular-shaped passages each equipped with a concentric converging nozzle at the tip of the burner, such as shown and described in coassigned U.S. Pat. No. 4,525,175, which is incorporated herein by reference. Thus, the stream of aqueous slurry of low rank coal may be passed through the first or third annular shaped passages, the free-oxygen containing gas stream may be passed through the central conduit, and the stream of liquid hydrocarbonaceous fuel, such as residual fuel oil may be passed through the third or first annular passage whichever is free. The feedstreams impact together inside the tip of the burner and/or downstream from the tip of the burner in the reaction zone of the partial oxidation gas generator. The feedstreams atomize, thoroughly mix together, and react by partial oxidation to produce synthesis gas, reducing gas, or fuel gas depending on the composition. In a similar manner, the feedstreams may be introduced by said burner means into a furnace or boiler and are burned therein to produce heat and/or steam.

The relative proportions of the fuel, water and oxygen in the feedstreams to the partial oxidation gas generator are carefully regulated to convert a substantial portion of the carbon in the feedstreams, e.g. up to about 90% or more by weight, to carbon oxides; and to maintain an autogenous reaction zone temperature in the range of about 1800° F. to 3500° F. and a pressure in the range of about 1 to 35 atmospheres. Preferably the temperature in the gasifier is in the range of about 2200° F. to 2800° F., so that molten slag is produced. Further, the weight ratio of $H_2O$ to carbon in the feed is in the range of about 0.2 to 3.0, such as about 1.0 to 2.0. The atomic ratio of free-oxygen to carbon in the feed is in the range of about 0.8 to 1.4, such as about 1.0 to 1.2.

The dwell time in the partial oxidation reaction zone is in the range of about 1 to 10 seconds, and preferably in the range of about 2 to 8 seconds. With substantially pure oxygen feed to the gas generator, the composition of the effluent gas from the gas generator in mole % dry basis may be as follows: $H_2$ 10 to 60, CO 20 to 60, $CO_2$ 5 to 40, $CH_4$ 0.01 to 5, $H_2S+COS$ nil to 5, $N_2$ nil to 5, and Ar nil to 1.5. With air feed to the gas generator, the composition of the generator effluent gas in mole % dry basis may be about as follows: $H_2$ 2 to 20, CO 5 to 35, $CO_2$ 5 to 25, $CH_4$ nil to 2, 1 $H_2S+COS$ nil to 3, $N_2$ 45 to 80, and Ar 0.5 to 1.5. Unconverted carbon, fly-ash and/or molten slag leave the gasifier along with the effluent gas stream. Depending on the composition and use, the effluent gas stream is called synthesis gas, reducing gas, or fuel gas. For example, synthesis gas and reducing gas are rich in $H_2+CO$, while fuel gas is rich in $H_2$, CO and $CH_4$. Low rank coal often has a high ash content e.g. about 10 to 40 wt. %. At higher temperatures, e.g. above about 2300° F., ash will flow from the reaction zone of the gas generator as substantially inert molten slag.

The hot gaseous effluent stream from the reaction zone of the synthesis gas generator is quickly cooled below the reaction temperature to a temperature in the range of about 250° F. to 700° F. by direct quenching in water, or by indirect heat exchange for example with water to produce steam in a gas cooler. Fly-ash and/or molten slag are removed during quenching and/or scrubbing of the effluent gas stream. The effluent gas stream may be cleaned and purified by conventional methods. For example, reference is made to coassigned U.S. Pat. No. 4,052,176, which is included herein by reference for removal of $H_2S$, COS and $CO_2$, from the effluent gas stream in a conventional gas purification zone. By this means, the effluent gas stream is purified and will not contaminate the environment.

In one embodiment, an additive is introduced into the partial oxidation reaction zone along with the other feed materials in order to facilitate the formation and removal of fly-ash and/or slag from the non-combustible materials found in the liquid hydrocarbonaceous fuel and in the low rank coal. The additive is selected from the group consisting of iron-containing material, calcium-containing material, silicon-containing material and mixtures thereof. About 0.1 to 10 parts by weight of additive is introduced into the gasifier for each part by weight of non-combustible materials. The iron-containing additive material is for example selected from the group consisting of iron, iron oxide, iron carbonate, iron nitrate, and mixtures thereof. The calcium-containing additive material is for example selected from the group consisting of calcium oxide, calcium hydroxide, calcium carbonate, calcium nitrate, calcium fluoride, calcium phosphate, calcium borate, and mixtures thereof. The silicon-containing additive material is for example selected from the group consisting of silica, quartz, silicates, volcanic ash, and mixtures thereof.

Clean synthesis gas as produced in the subject process may be used in the catalytic synthesis of organic chemicals. For example, methanol and acetic acid may be synthesized in accordance with the process described in coassigned U.S. Pat. No. 4,081,253, which is incorporated herein.

Fuel gas produced in the subject process may be burned in the combustor of a gas turbine. Flue gas from the combustor may be the working fluid in an expansion turbine which powers an electric generator.

EXAMPLES

The following examples are submitted for illustrative purposes only, and it should not be construed that the invention is restricted thereto.

The partial oxidation of low rank coals in a conventional downflowing gasifier is often not very attractive economically because of excessive coal and oxygen requirements per unit of syngas (hydrogen plus carbon monoxide) produced. This is also reflected in a low cold gas efficiency (heating value of $H_2+CO$ produced as % of heating value of hydrocarbon feedstock).

The results of a series of runs which show the improved performance of low rank coal-water slurries when residual fuel oil is gasified simultaneously in the same partial oxidation gasifier are summarized in Table IV and in FIG. 1. The properties of the feedstock are shown in Table III.

On the basis of these runs the following two unexpected results are noted:

1. Small additions of residual fuel oil to low rank coal-water slurries have large beneficial effects. Runs 1 and 3 (Table IV) show that a 2.9% wt % addition of residual fuel oil to the total feed (4.9 wt % basis dry feed) results in a 11.6 wt % reduction in the coal feedrate plus a 6.14 wt % reduction in the oxygen feedrate.
2. Larger additions of residual fuel oil result in progressively less beneficial results. Runs 1 and 4 show that a 23.3 wt % residual oil addition (34.0 wt % basis dry feed) results in a 56.7 wt % reduction in the coal feedrate plus a 30 wt % reduction in the oxygen feedrate.

FIG. 1 illustrates how the beneficial effect of residual fuel oil addition to low rank coal slurries results in a steep slope up to about 3 wt % (4.9 wt % basis dry feed), then curves gradually up to about 30 wt %, and becomes almost flat beyond 30 wt %.

The additional interesting observation is that better results are obtained by feeding the residual oil together with the low grade coal-water slurry simultaneously into the same reactor rather than by feeding the same ratio of residual fuel oil and low rank coal-water slurry into separate reactors operating at the same conditions to produce the same amount of product gas ($H_2+CO$). This is evident by comparing Runs 2 and 5, 3 and 6, 4 and 7, respectively, in Table IV.

It is therefore proposed that a commercially attractive way to improve the gasification performance of low rank coals is to simultaneously introduce into the reaction zone of a partial oxidation gas generator by way of a three stream burner, small amounts of low grade and low value, heavy residual fuel oil and a low rank coal-water slurry feedstream. Quantities of residual fuel oil up to about 3 wt % basis the total feed to the gasifier would have the greatest leverage effect, whereas quantities up to about 30 wt % would be beneficial and quantities above about 30 wt % would be of doubtful value.

TABLE III

| FEEDSTOCK PROPERTIES | Sumatra Bukit Asam Coal | | |
|---|---|---|---|
| | Wet | Dry | Residual Fuel Oil |
| PROX. ANALYSIS | | Dry | |
| Moist, Wt. % | 23.6 | 0.0 | |
| Ash | 4.0 | 5.2 | |
| Volat. Mat. | 32.1 | 42.0 | |
| Fixed C | 40.3 | 52.7 | |
| TOTAL | 100.0 | 100.0 | |
| ULTIM. ANALYSIS | | | |
| C, Wt. % | 55.5 | 72.6 | 83.48 |
| H | 3.9 | 5.1 | 10.80 |
| N | 0.9 | 1.2 | 0.00 |
| S | 0.5 | 0.7 | 5.72 |
| O inorg. | 10.6 | 13.9 | 0.00 |
| Ash | 5.0 | 6.5 | 0.00 |
| Moisture | 23.6 | 0.0 | 0.00 |
| TOTAL | 100.0 | 100.0 | 100.0 |
| HHV, kcal/kg | 5504 | 7204 | |
| Btu/lb | 9907 | 12968 | |
| Calc. Btu/lb | | 12742 | 18006 |
| Ash Fluid Ox., °C. | 1443 | | |
| , °F. | 2629 | | |
| Gravity, °API | | | 8.4 |

TABLE IV

| COAL-WATER RESIDUAL FUEL OIL BLENDS (BASIS: 100 MM SCFD $H_2$ + CO) | | | | | | | |
|---|---|---|---|---|---|---|---|
| Run No. | 1 | 2 | 3 | 4 | 5 | 6 | 7 |
| Type | 100% Coal | Blend | Blend | Blend | Separate | Separate | Separate |
| COAL, tons/day | 2721 | 2686 | 2406 | 1179 | 2689 | 2430 | 1238 |
| Reduction oven Run #1, % | 0.00 | 1.29 | 11.6 | 56.7 | 1.18 | 10.7 | 54.5 |
| RESIDUAL FUEL OIL, tons/day | 0 | 13.85 | 124.0 | 607.6 | 13.86 | 125.3 | 638.1 |
| $O_2$ Pure, tons/day | 2425 | 2409 | 2276 | 1698 | 2413 | 2316 | 1868 |
| Reduction over Run #1, % | 0.00 | 0.66 | 6.14 | 30.0 | 0.50 | 4.49 | 23.0 |
| RAW FEEDSTOCKS | | | | | | | |
| Coal, as received, Wt. % | 100.0 | 99.5 | 95.1 | 66.0 | 99.5 | 95.1 | 66.0 |
| Residual Fuel Oil, Wt. % | 0.0 | 0.51 | 4.9 | 34.0 | 0.51 | 4.9 | 34.0 |
| Total | 100.0 | 100.0 | 100.0 | 100.0 | 100.0 | 100.0 | 100.0 |
| TOTAL FEED | | | | | | | |
| Coal, moist. free, Wt. % | 45.0 | 44.9 | 43.7 | 34.5 | 44.8 | 43.2 | 31.6 |
| Residual Fuel Oil, Wt. % | 0.0 | 0.30 | 2.9 | 23.3 | 0.30 | 2.9 | 21.3 |
| Water, total, Wt. % | 55.0 | 54.8 | 53.4 | 42.2 | 54.9 | 53.9 | 47.1 |
| Total | 100.0 | 100.0 | 100.0 | 100.0 | 100.0 | 100.0 | 100.0 |
| Cold Gas Efficiency, % | 61.1 | 61.33 | 63.2 | 72.8 | 61.25 | 62.6 | 69.9 |
| Improv't, % points | 0 | 0.23 | 2.1 | 11.7 | 0.15 | 1.5 | 8.8 |

Various modification of the invention as herein before set forth may be made without departing from the spirit and scope thereof and therefore only such limitations should be made as are indicated in the appended claims.

I claim:

1. A process for the partial oxidation of low rank coal comprising:

(1) mixing together about 30 to 45 parts by wt. of comminuted low rank coal selected from the group consisting of subbituminous, lignite and mixtures thereof and conforming with ASTM D388 Class III subbituminous and Class IV Lignitic fuel and about 70 to 55 parts by wt. of water to produce a pumpable aqueous low rank coal slurry stream;

(2) passing the aqueous-low rank coal slurry stream from (1) into the reaction zone of a free-flow partial oxidation gas generator by way of a first passage of a multi-passage burner;

(3) simultaneously passing into the reaction zone of said partial oxidation gas generator by way of a second passage in said multi-passage burner about 1 to 3 parts by wt. of a stream of residual fuel oil having a calorific value of at least 14,000 Btu/lb and conforming with Grades No. 4 to 6 of ASTM D-396;

(4) simultaneously passing a stream of free-oxygen containing gas into said reaction zone by way of at least one other free passage of said burner;

(5) impacting together inside the tip of the burner and/or downstream from the tip of the burner in said reaction zone by atomizing and mixing together said stream of aqueous low rank coal slurry, said stream of residual fuel oil, and said stream of free-oxygen containing gas; and (6) reacting said mixture from (5) in said reaction zone of said partial oxidation gas generator at a temperature in the range of about 1800° F. to 3500° F., a pressure in the range of about 1 to 35 atmospheres, and an atomic ratio of free-oxygen to carbon in the range of about 0.85 to 1.5 to produce a hot effluent stream of synthesis gas, reducing gas or fuel gas.

2. The process of claim 1 further provided with the additional steps of cooling, cleaning and purifying said hot effluent stream of synthesis gas, reducing gas, or fuel gas.

* * * * *